United States Patent [19]

Bauer et al.

[11] Patent Number: 4,718,731

[45] Date of Patent: Jan. 12, 1988

[54] MILLING FIXTURE FOR A SLOTTED WALL MILLING CUTTER

[75] Inventors: Karlheinz Bauer; Johann Haberer, both of Schrobenhausen; Maximilian M. Arzberger, Igenhausen, all of Fed. Rep. of Germany

[73] Assignee: Karl Bauer Spezialtiefbau GmbH & Co. KG, Schrobenhausen, Fed. Rep. of Germany

[21] Appl. No.: 860,817

[22] Filed: May 8, 1986

[30] Foreign Application Priority Data

Jun. 3, 1985 [DE] Fed. Rep. of Germany ..... 3519774

[51] Int. Cl.[4] ..... E21C 27/24

[52] U.S. Cl. ..... 299/85; 299/89

[58] Field of Search ..... 299/85, 86, 91, 42, 299/80, 89

[56] References Cited

U.S. PATENT DOCUMENTS

| | | | |
|---|---|---|---|
| 2,752,142 | 6/1956 | Joy | 299/89 |
| 3,439,758 | 4/1969 | Petersen | 299/85 |
| 3,857,610 | 12/1974 | Snyder | 299/86 |
| 4,172,616 | 10/1979 | Delli-Gatti | 299/89 X |

FOREIGN PATENT DOCUMENTS

| | | | |
|---|---|---|---|
| 2719160 | 11/1977 | Fed. Rep. of Germany . | |
| 467181 | 4/1975 | U.S.S.R. | 299/89 |

*Primary Examiner*—Stephen J. Novosad
*Assistant Examiner*—David J. Bagnell
*Attorney, Agent, or Firm*—Fleit, Jacobson, Cohn & Price

[57] ABSTRACT

In a slotted wall milling cutter for excavation work, the milling wheel arranged laterally of a bearing bracket, mounted in rotary manner in the latter and equipped over its circumferential surface with radially projecting milling teeth has at least one milling tooth pivotable at right angles to the circumferential direction. This fixture permits a complete working of the entire milling cross-section.

2 Claims, 3 Drawing Figures

MILLING FIXTURE FOR A SLOTTED WALL MILLING CUTTER

Figure 1:
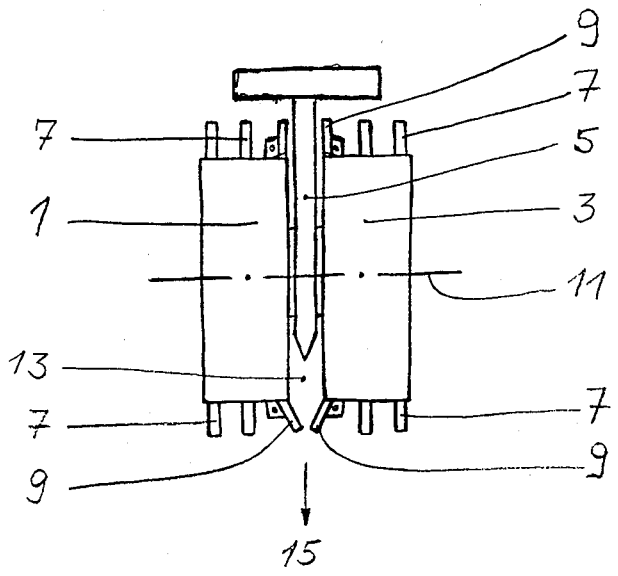

The present invention relates to a milling fixture for a slotted wall milling cutter for excavation work.

Known slotted wall milling cutters for excavation work are conventionally equipped with two milling or cutting wheels, the latter being circumferentially radially provided with projecting fixed teeth. The teeth in each case form several spaced gear rims arranged in the axial direction of the milling cutter. As there are no teeth in the free space between two adjacent gear rims, the milling cross-section covered by the milling wheels only works that part on which the teeth directly act. The ground portions located in the gaps between two adjacent gear rims are not milled away and must instead be forced away from the milling wheel hub by the pressure exerted on the milling wheels. If the milling wheels are arranged on either side of a bearing bracket, the known milling fixtures are also unable to work the zone located beneath the bearing bracket. The ground area left there also makes an elevated pressure necessary, permit the advance downwards of the slotted wall milling cutter. The web left behind below the bearing bracket, together with the unmilled or uncut material between two adjacent gear rims, are prejudicial to a speedy milling or cutting advance.

The problem of the present invention is to provide a milling attachment for a slotted wall milling cutter of the aforementioned type which, in the case of a simple, robust construction, permits a complete working of the entire milling cross-section covered by the milling attachment.

According to the basic principle of the invention at least one of the radially projecting milling or cutting teeth is constructed so as to be pivotable at right angles to the circumferential direction of the milling wheel. Thus, the pivotable milling tooth is also able to work the area adjacent to a gear rim plane. The pivotable arrangement of the milling tooth is necessary, because if this tooth is past through the area located below the bearing bracket, it would have to be moved back into its swung in position, because the tooth must avoid the bearing bracket in the upper milling wheel area.

The fixture according to the invention has a particularly simple construction and the pivoting movements always take place from the swung in position into the swung out position and vice versa take place automatically during the advance of the slotted wall milling cutter. Due to the fact the pivotable milling tooth can only move aside in a given direction, it is automatically pivoted into said swung out position during the pressing down of the slotted wall milling cutter.

According to a preferred embodiment, the pivotable milling tooth is located on a circumferential portion of the milling wheel adjacent to the bearing bracket and can be swung out in the direction of the latter, so that in the swung out position it engages in the zone located below the bearing bracket. It is consequently possible to mill away the web located below the bearing bracket in an advantageous manner. The swinging in process of the milling tooth takes place automatically, because the swung out milling tooth during its upward movement out of the zone located below the bearing bracket is forced by a portion of said bracket into its swung in position. In the upper portion, the outwardly swingable milling tooth is substantially parallel to the bearing bracket and during the milling process is moved circumferentially in spaced manner with respect thereto. The milling tooth maintains the swung in position until it is swung out again during the downward movement under the pressure or the weight of the milling cutter. Even before the said milling tooth is exposed to pressure action, the dimensions of the bearing bracket are reduced to such a extent that the milling tooth can move in an unimpeded manner in the direction of the zone located below the bearing bracket.

According to another embodiment a lever arm is fixed to that portion of the outwardly swingable milling tooth, which is adjacent to the milling wheel hub and said arm has a bolt pivotably received in a bearing fixed to the wheel hub. The bolt axis is aligned tangentially to the milling wheel circumference. Even a fixture characterized solely by these features is in a position to work the web located below the bearing bracket and then return to the initial position following the milling or cutting process.

According to the invention, the bolt axis in the axial direction of the milling wheel can be positioned in spaced manner with respect to the central axis of the outwardly swingable milling tooth, the latter being arranged directly on the axial end portion of the circumferential edge of the milling wheel hub. The advantage of this embodiment is that the actual milling tooth can be positioned directly on the axial end portion of the circumferential edge of the milling wheel hub and can therefore be swung over the minimum distances into the zone to be worked.

In the embodiment with the bolt and milling tooth axially displaced with respect to one another, in order to ensure the swinging out of the milling tooth the lever arm can be provided on it area remote from the axial end portion of the milling wheel hub with a stop, which engages on the wheel hub when the outwardly swingable milling tooth is in the swung in position. This ensures that during the lowering of the slotted wall milling cutter the tooth is always forced in the direction of the bearing bracket. The outwardly swingable milling tooth is aligned preferably vertically to the milling wheel axis in the swung in position.

According to a preferred embodiment, the outwardly swingable milling tooth is aligned with the axial end portion of the milling wheel hub in the swung in position. As a result of this arrangement, said milling tooth, in the same way as the actual milling wheel, can be turned at a limited distance from the bearing bracket and said outwardly swingable milling tooth does not rub along the said bracket in the upper region of the milling wheel, where it is directly adjacent to said bracket.

According to another embodiment, in the area between the milling tooth side adjacent to the bearing bracket and the lever arm stop an oblique plane is provided. When the milling tooth is in the swung out state, the oblique plane rests fully and evenly on the milling wheel hub, so that the force introduced during the milling process can be transferred in the same way as with a milling tooth fixed to the milling wheel with the full connecting cross-section.

In the swung in state, the oblique plane forms an acute angle with the milling wheel hub. By means of the magnitude of this acute angle, it is possible to adapt the engagement width of the outwardly swingable milling tooth below the bearing bracket to the particular requirements of the case. The larger the acute angle, the further the outwardly swingable milling tooth engages into the zone located below the bearing bracket.

Since the pivoting movement below the bearing bracket leads to a certain loss of effective length of the milling tooth in the radial direction, the outwardly swingable milling tooth can be made longer than the remaining, fixed teeth of the milling wheel, so that in milling engagement is has the same radial extension as the other fixed milling teeth.

Particular efficiency when working the ground area located below the bearing bracket can be achieved if the milling wheel is provided over its entire circumferential area adjacent to the bearing bracket with a rim of circumferentially alternating fixed milling teeth and outwardly swingable milling teeth.

In the case of the conventional slotted wall milling cutters equipped with two milling teeth, in which the latter are arranged on either side of the bearing bracket, both circumferential surfaces of the milling wheels adjacent to the bearing bracket are equipped with milling teeth according to the invention. The zone located below the bearing bracket can either be worked on both sides simultaneously by the outwardly swingable milling teeth of the adjacent milling wheels or the milling wheels can be displaced with respect to one another by a given angle, so that the outwardly swingable milling teeth of the adjacent milling wheels follow one another circumferentially in displaced manner.

Preferably the milling wheel is provided over its entire circumference with a plurality of milling teeth pivotable in the direction of the bearing bracket and distributed in alternating manner with respect to the fixed milling teeth. Further more, on the area adjacent to the bearing bracket, the milling wheel can have milling teeth which can be swung out in the direction of the bracket, whilst over the remaining circumferential area there are several milling teeth pivotable in the opposite direction to the bracket and arranged in alternating manner with respect to the fixed milling teeth. The pivotable milling teeth distributed over the remaining circumferential area can also be arranged in such a way that of two pivotable milling teeth which follow one another circumferentially, one is pivotable in the direction of the bearing bracket and the other in the opposite direction.

The milling teeth arranged on the circumferential area of the milling wheel adjacent to the bearing bracket can be moved by the latter from the swung out position into the swung in position. The swinging in process is completed by the milling tooth, after passing through the zone located below the bearing bracket abutting against the latter, so that it is forced into the swung in position. To this end the circumferential portion of the bearing bracket located between the milling wheels is constructed in such a way that it converges outwards in V-shaped manner, which greatly facilitates the swinging in process of the milling tooth.

The pivotable milling teeth distributed over the remaining circumferential area of the milling wheel can be moved by a reamer into the swung in position and which is fixed to a gear shield or bracket arranged above the milling wheel and engages between the vertically aligned milling teeth.

The invention is described in greater detail hereinafter relative to non-limitative embodiments and the attached drawings, wherein show:

FIG. 1, a front view of a first embodiment of the invention.

Figure 2:
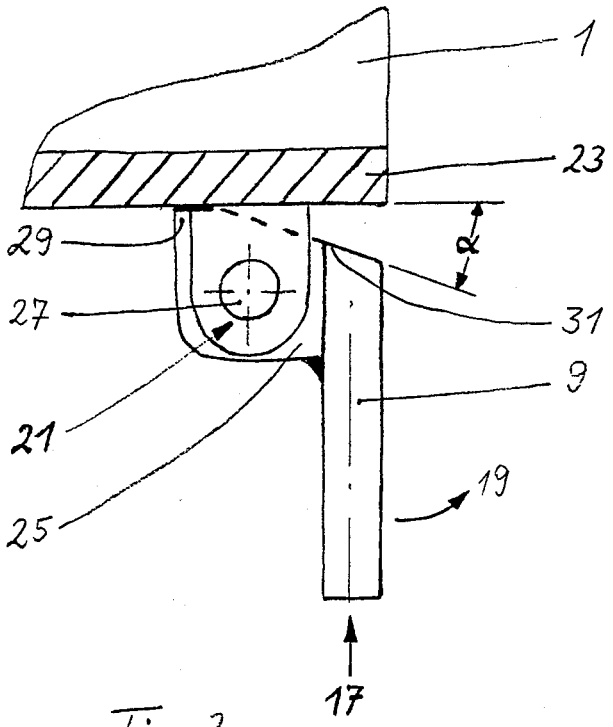

FIG. 2, a partial section through an outwardly swingable milling tooth fixed to the milling wheel hub.

Figure 3:
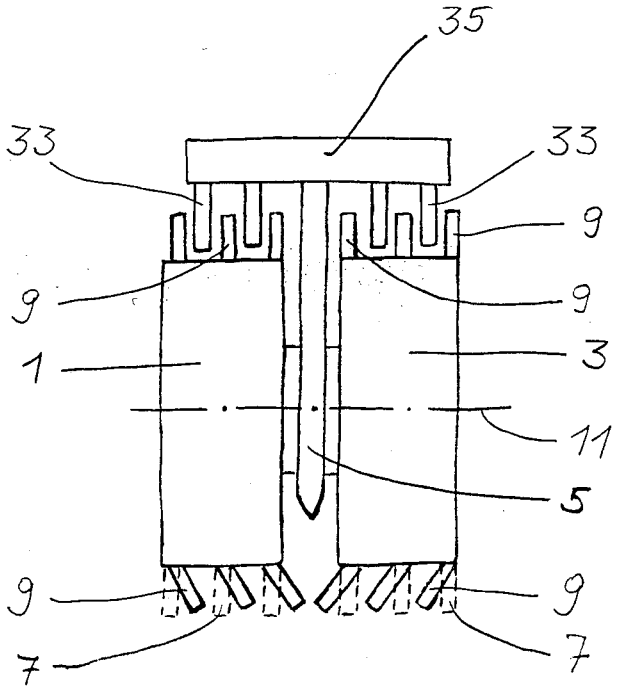

FIG. 3, a front view of a second embodiment of the invention.

FIG. 1 shows an arrangement of two milling wheels 1, 3 on either side of a bearing bracket 5 of a slotted wall milling cutter. Milling wheels 1, 3 are mounted in rotary manner in bearing bracket 5, are provided over their circumferential surface with fixed milling teeth 7 and have on their circumferential portions adjacent to the bearing bracket milling teeth 9 pivotable in the direction of said bracket. In the upper portion of the milling wheels the outwardly swingable milling teeth 9 are aligned substantially vertically with respect to the milling wheel axis 11 in the same way as the fixed milling teeth 7. In the lower portion of the milling wheels, the milling teeth 9 are shown in their swung out position and engage on either side simultaneously in the zone 13 below bearing bracket 5. The swung out position of the milling wheels is brought about by placing the slotted wall milling cutter on the still unworked ground in that the outwardly swingable milling teeth 9 are forced in the direction of bearing bracket 5 due to the weight of the cutter and their eccentric mounting. During the milling process, during which the slotted wall milling cutter advances in the direction indicated by arrow 15, each outwardly swingable milling tooth 9 is forced into the swung out position in the same way by the weight of the cutter. In the present embodiment, the two facing outwardly swingable milling teeth 9 of the adjacent wheels 1, 3 are roughly of the same length as the fixed milling teeth 7. In an embodiment in which only one of the adjacent milling wheels 1, 3 is equipped with outwardly swingable milling teeth, the teeth 9 are longer than the teeth 7, so that the zone located below the bearing bracket 5 can be traversed as completely as possible. After passing through the zone 13 below bearing bracket 5, milling teeth 9 abut against bracket 5, so that they are pivoted back into the swung in position. For this purpose, the circumferential portion of the bearing bracket 5, against which abuts the milling teeth 9, converges outwards in V-shaped manner. Due to this design of bearing bracket 5, the outwardly swung milling teeth 9 are continuously pressed into the inoperative position.

FIG. 2 shows the preferred mounting of an outwardly swingable milling tooth 9. If a force acts in the direction of arrow 17 on milling tooth 9, it is swung out in the direction of arrow 19 due to the force application acting eccentrically to bearing 21, so that the milling tooth comes into working engagement.

A lever arm 25 is welded onto the outwardly milling tooth 9 and specifically to the portion adjacent to the hub 23 of milling wheel 1. Lever arm 25 is provided with a bolt 27 aligned tangentially to the milling wheel circumference and which is received in a bearing 21 fixed to the hub 23 of milling wheel 1. The axis of bolt 27 is arranged in spaced manner with respect to the central axis of the outwardly swingable milling tooth 9, the latter being arranged on the axial end portion of hub 23 of milling wheel 1. In order that the outwardly swingable milling tooth 9 remains aligned roughly in a vertical position for milling engagement during the downward movement and cannot be pivoted counter to the direction indicated by arrow 19, the lever arm is provided in its area remote from the axial end portion of hub 23 of milling wheel 1 with a stop 29. Precisely in the position in which the ouwardly swingable milling tooth 9 is roughly vertically aligned, the stop 29 engages on hub 23 of milling wheel 1. The outwardly swingable milling tooth 9 is aligned with the axial end portion of hub 23 of milling wheel 1, so that the path to milling engagement is as short as possible.

In the area between stop 29 and the outside of the outwardly swingable milling tooth 9, lever 25 and tooth 9 are bevelled in the manner of an oblique plane 31. When the milling tooth 9 is swung out, the oblique plane 31 engages on hub 23 of milling wheel 1. When milling tooth 9 is swung in, the oblique plane 31 forms an acute angle $\alpha$ with the hub 23 of milling wheel 1.

According to FIG. 3 all the milling teeth 9 arranged on the circumferential surfaces of milling wheels 1 and 3, are constructed pivotably in the direction of the bearing bracket 5. In FIG. 3 the outwardly swingable milling teeth 9 are represented by continuous lines, whilst the broken lines represent the circumferentially alternating sequence of the fixed milling teeth 7 with respect to the outwardly swingable milling teeth 9.

Milling teeth 9 can be moved into the swung in position by reamers 33, which are fixed to a gear shield or plate 35 and which are in each case located between the teeth 9. In this arrangement, the reamers are in each case fitted between those planes in which the milling teeth 9 are arranged on the circumferential surface of milling wheels 1 and 3.

We claim:

1. A milling fixture for a slotted wall milling cutter used for excavation work, said milling fixture comprising:

a bearing bracket, at least one milling wheel positioned laterally of said bearing bracket, said at least one milling wheel being rotatably mounted on said bearing bracket, substantially radially projecting fixed milling teeth provided on a circumferential surface of said at least one milling wheel, swingable milling teeth arranged along said circumferential surface of said at least one milling wheel adjacent to said bearing bracket, said swingable milling teeth being pivotable out of their radial extension which is located at right angles to the circumferential rotational direction of said at least one milling wheel, each of said swingable milling teeth being fixed to a lever arm, said lever arm forming a bolt opening having a bolt passing therethrough, said bolt being received in a bearing fixed to a hub of said at least one milling wheel, said bolt opening being aligned tangentially to the circumference of said at least one milling wheel, said lever arm being provided with a stop, said stop, in a swung-in position of said swingable milling teeth, engages said hub of said at least one least one milling wheel, said lever arm being being further provided with an oblique plane forming an acute angle with said hub in said swung-in position of said swingable milling teeth and engages with said hub in a swung-out position of said swingable milling teeth, and said stop and said oblique plane are located on opposite sides of a longitudinal axis of said bolt.

2. A milling fixture according to claim 1, wherein a portion of said oblique plane is formed on said lever arm between said stop and another portion of said oblique plane which is located on the opposite side of said longitudinal axis of said bolt from said stop.

* * * * *